United States Patent [19]

Carle et al.

[11] Patent Number: 4,775,062

[45] Date of Patent: Oct. 4, 1988

[54] CHILD RESISTANT CLOSURE CAP FOR NECKED CANS OR CONTAINERS

[75] Inventors: Richard Carle, Martinsville; Joseph E. Murphy, Basking Ridge, both of N.J.

[73] Assignee: Berry Plastics, Inc. (Indiana Corp.), Evansville, Ind.

[21] Appl. No.: 37,020

[22] Filed: Apr. 10, 1987

[51] Int. Cl.[4] ..... B65D 55/02

[52] U.S. Cl. ..... 215/216; 215/224

[58] Field of Search ..... 215/216, 224, 225, 317, 215/321

[56] References Cited

U.S. PATENT DOCUMENTS

| | | | |
|---|---|---|---|
| 4,375,859 | 3/1983 | Fillmore | 215/224 |
| 4,588,097 | 5/1986 | Hauser | 215/216 |
| 4,687,112 | 8/1987 | Swartzbaugh | 215/216 |

*Primary Examiner*—George T. Hall

*Attorney, Agent, or Firm*—Arthur L. Plevy

[57] ABSTRACT

A child resistant cap is desirably fastened onto a container which container has a peripheral recess located below an extending top dome portion. The cap has a first inner partial peripheral flange having a given opening and a second inner partial peripheral flange located above said first flange and having a diametrically opposed opening, with said first flange inserted into said recess to cause said second flange to coact with said extending top portion when said cap is emplaced on said container.

16 Claims, 2 Drawing Sheets

CHILD RESISTANT CLOSURE CAP FOR NECKED CANS OR CONTAINERS

BACKGROUND OF THE INVENTION

This invention relates to a child resistant closure cap for selectively gaining access to a container or a can and more particularly to a child resistant overcap for a necked can of container configuration.

As one can ascertain, it is a well known problem that serious health damage can occur to young children who have a tendency to play with various containers found in the typical household.

As is acknowledged, such containers by of example may contain pharmaceutical preparations and in the case of aerosol containers may dispense sprays of insecticides, paints and other chemicals which can severely injure the child. The problem is serious and has been recognized in legislation (The Poison Prevention Packaging Act). This Act was enacted in 1970. The Act recognizes that there is a direct need to protect young children from such injuries and to therefore place a duty the upon a manufacturer of noxious substances to include in the design of a container a child resistant or child proof closure.

As indicated, the prior art is aware of such problems and reference is made to U.S. Pat. No. 4,315,576 issued on Feb. 16, 1982 and entitled CHILD RESISTANT CLOSURE CAP APPARATUS EMPLOYING FULCRUM ACTION by Joseph E. Murphy et al and assigned to the assignee herein, namely, Gilbert plastics, Inc. of New Brunswick, N.J. In that patent, there is a relatively detailed description of prior art safety caps which are essentially child proof and which consist of various locking mechanisms to prevent the inadvertent opening of containers by a child.

As indicated, it is clear that the prior art devices are quite diverse and operate on various principals such as selective rotation and alignment or the exertion of predetermined forces at particular points. It is further clear that certain of the devices of the prior art, especially those relating to aerosol containers, are extremely complicated and difficult to manufacture due to their composite structure such as containing inner and outer shell mechanisms. Recently, there is available a series of cans or containers which are necked devices and as such include a peripheral ridge or recess which is positioned below a top spout portion. These cans typically are fabricated from aluminum and are adapted to contain pharmaceuticals, insecticides and various other deleterious substances. Hence, in view of such cans it also desirable to provide a child resistant closure cap for the containers as well.

It is therefore an object of the present invention to provide an improved child resistant closure cap which cap is economical to manufacture and which is adapted to be used with necked cans or containers. The cap to be described is particularly adaptable to be emplaced and employed with these containers although other containers such as bottles and so on can also be used with the closure structure.

BRIEF DESCRIPTION OF THE PREFERRED EMBODIMENT

A child resistant closure cap apparatus for covering a container, said container of the type having a peripheral recess, with said recess positioned below an extending top portion associated with a substance removal end of said container, comprising a cup-shaped member having a closed top surface and an opened bottom, said cup shaped member having a first partial inner peripheral flange near said opened bottom and having a circumferential opening said first flange adapted to coact with said peripheral recess in said container, with a second partial inner peripheral flange located above said first flange and having a diametrically opposed opening with said second flange adapted to be positioned on said top portion when said first flange is coacting with said recess.

DETAILED DESCRIPTION OF THE INVENTION

Figure 1:
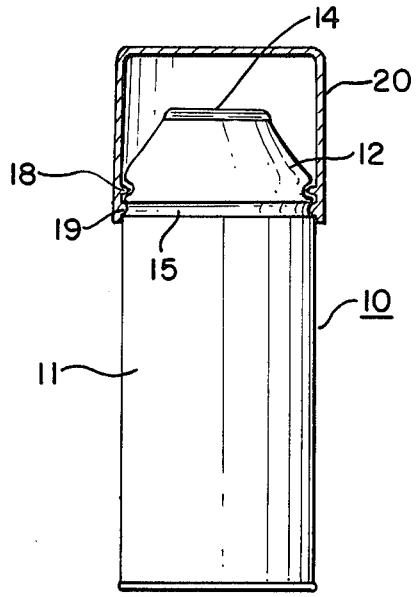
FIG. 1 is a front plan view of a closure cap partially in cross section illustrating the affixation of the cap to a necked container.

Referring to FIG. 1, there is shown a typical example of a can or container 10 to which a closure cap 20 according to this invention is secured. The container assembly includes a longitudinal cylindrical body portion 11 which may be fabricated from a metal such as aluminum. The top portion 12 of the can is arcuate in shape and has sloping contoured surfaces which terminate in an upper portion 14 designated as a pouring spout. It is also indicated that the upper portion 14 may contain an aerosol valve or other suitable mechanism to allow the contents of the can 10 to be ejected by manipulation of the valve. Such valves as well as pressurized fluids which can be accommodated by such containers as 10 are well known in the art.

In any event, as one can ascertain from FIG. 1, there is a peripheral recess 15 which essentially is fabricated in the can. The recess 15 is a peripheral recess and extends about the outer periphery of the can separating the cylindrical portion 11 from the top dome section 12. The section 12 shown in FIG. 1 is by way of representation only and various other configurations can be employed as well. The closure cap 20 is fabricated from a suitable flexible plastic such as a high density polyethylene plastic and contains at predetermined locations about the inner periphery two partial inner peripheral flanges. Each of the inner flanges depicted by reference numerals 18 and 19 is a partial circular configuration having a predetermined circumferential opening at opposite ends. The opening of the bottom flange 19 and the top flange 18 are positioned 180° apart. The opening is a circumferential opening and occupies a given angle. As will be explained, once the cap is emplaced on the can, a typical pulling action will not enable a child to apply the necessary force to pull the cap off the can in a vertical direction. This is especially true of a child.

As will be explained, in order to remove the cap, one has to exert a pressure for force directly above one of the circumferential openings to thereby dislodge the cap from the can. As one can see from FIG. 1, one of the semicircular flanges as 19 is secured within or coacts with the recess 15. The other semicircular flange as 18 rests or rides upon the container surface 12 and acts to coact with this surface in a manner to be described.

Figure 2:
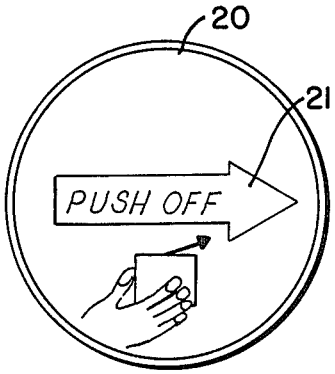
FIG. 2 is a top plan view of the cap according to this invention.

Referring to FIG. 2, there is shown a top plan view of the cap 20. Essentially, the cap includes indicia indicated by reference numeral 21 indicating to a consumer where to apply the force in order to dislodge the cap when emplaced on the container. The cap surface may further include a simple diagram showing the cap removal procedure as for example showing a cap held in one's hand and the use of the thumb to push the cap off the container.

Figure 3:
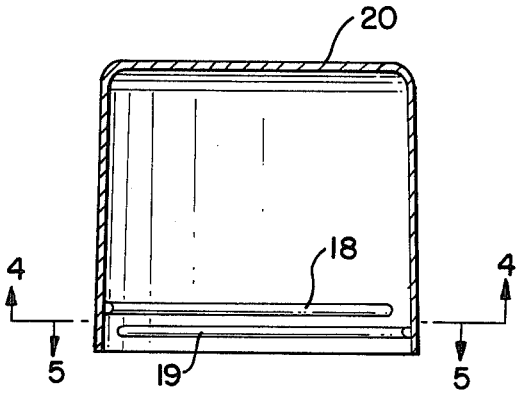
FIG. 3 is a cross sectional view of the cap shown in FIG. 2.

Referring to FIG. 3, there is shown a cross-sectional view of the cap 20. The cap 20 is a cup-shaped member having a closed top and an opened bottom and is relatively conventional in appearance. As one can see from FIG. 3, there are two partial circular flanges which are positioned one above the other near the bottom of the cap. One flange designated as 19 is adapted to coact with the recess 15 formed in the container or can structure 10. The other peripheral flange 18 is also a partial circular structure in configuration and is adapted to coact with the top portion 12 of the can. It is indicated and understood that while a particular type of can or container 10 is depicted in FIG. 1, various other configurations can be employed as well. The main consideration for the can or container is that it has a recess as 15 which is coextensive with a top portion of similar or lesser diameter.

Figure 4:
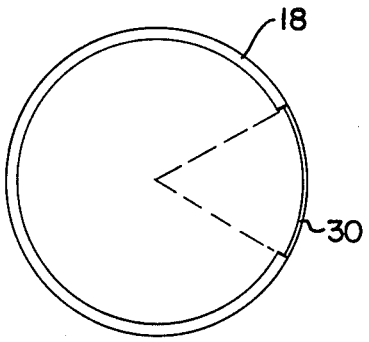
FIG. 4 is a view taken through line 4—4 of FIG. 3.

As one can see from FIG. 4, the peripheral flange 18 is partially circular in configuration and extends about the periphery of the cap 20 but has an opening 30 which is circumferential and occupies between 30° to 90°.

Figure 5:
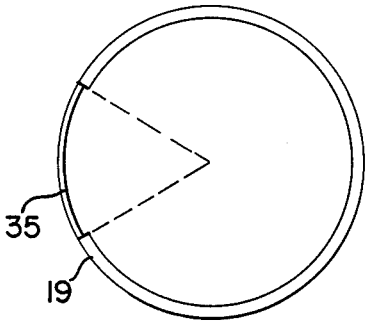
FIG. 5 is a view taken through line 5—5 of FIG. 3.

In a similar manner, referring to FIG. 5, the peripheral or circular flange 19 also has an opening 35 which again is between 30° to 90°. As one can ascertain by looking at FIGS. 4 and 5, the openings are diametrically opposed or are separated 180° one from the other. In this manner and again referring to FIG. 1, when the cap is emplaced upon the container or can 10, the peripheral ridge or flange 19 rides in the recess 15, while the ridge or flange 18 abuts against the side surfaces of the top portion 112. As one can therefore ascertain, in this manner, if one pushes down upon the cap, as for example the vertical direction, the partial circular ridge 18 abuts up against the top portion of the can 12 which essentially prevents one from unlocking the peripheral ridge 19 from the recess 15.

In any event, as one can ascertain, if one pushes the top surface of the cap that underlies the opening 30, one will essentially distort the cap configuration due to the fact that there is no flange portion in the area 30. This causes the cap to flex thus distorting the bottom flange which rides in the recess 15. In this manner, the flange 19 dislodges from the recess 15 and thereby enables the cap 20 to be removed from the container 10. In any event, various tests have been performed which show that it is extremely difficult for a child to perform the necessary manipulations to dislodge the cap as described above.

It is further extremely difficult for a child to impart the necessary forces to enable removal or to disengage the flange 19 from the peripheral recess 15 as located about the periphery of the can or container 10.

In any event, the necessary force to accomplish removal is not easily provided by a young child, especially by a child between the ages of a few months to five years or more. It is, of course, understood that the protection desired in regard to children of this age is of paramount importance as older children, for example, will tend to exercise greater caution and are more likely to be aware of the consequences in the unauthorized use of such containers. The cap structure as described above is extremely simple to implement from a manufacturing point of view as essentially the cap can be easily molded in a single procedure by typical injection or other plastic molding processes. The cross-sectional configurations of the circular flanges as 18 and 19 are semicircular or rounded in cross section.

Figure 6:
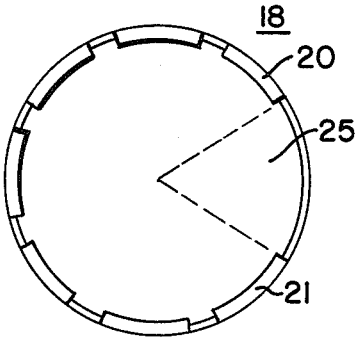
FIG. 6 is a bottom plan view depicting an alternate peripheral flange configuration.

In any event, they can be triangular or of any other suitable configuration depending on the shape of the recess 15 as implemented in the container 10. While flanges shown above are completely peripheral flanges, it is of course understood as shown in FIG. 6 that the flanges do not have to be continuous flanges. Hence, flanges 18 and 19 both may consist of spaced partial projecting elements as 20 and 21 which are spaced about the periphery and separated by a suitable distance in order to provide a good seal. These flanges or extending projections form a peripheral flange as flanges 18 and 19 and essentially provide the same modes of operation for the abovedescribed mechanism. As shown in FIG. 6, the partial circumferential opening is also provided by means of the space projections as 20 and 21 which are sometimes referred to as undercuts. In this manner, the peripheral opening is provided by not including such projections in the area designated as 25. It should be immediately apparent to one skilled in the art by referring to FIG. 6 that the peripheral flanges can constitute a series of peripheral undercuts such as shown in FIG. 6 which are suitable spaced to provide necessary rigidity. In this manner both flanges 18 and 19 can be implemented by utilizing such undercuts with the undercuts forming a peripheral flange with the partial circumferential openings of each of the flanges as 18 and 19 being diametrically opposed.

Figure 7:
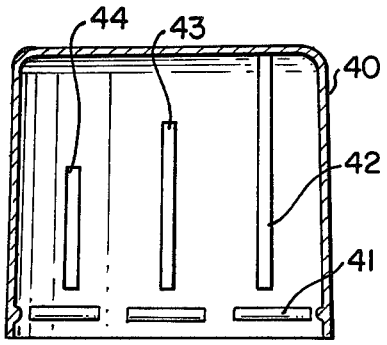
FIG. 7 is a cross sectional view of a cap employing an alternate arrangement for a top peripheral flange means.

Referring to FIG. 7, there is shown a cross sectional view of a cap employing still another alternate embodiment. In FIG. 7 the bottom flange which would be similar to flange 19 again consists of a series of segmented undercuts as 41 each of which projects to form a suitable peripheral flange having a circumferential opening as for example that opening 25 of FIG. 6. In any event, the top flange as flange 18 may consist of a series of vertical ribs as 44, 43 and 42 which are spaced about the inner periphery of the cap and as shown.

Figure 8:
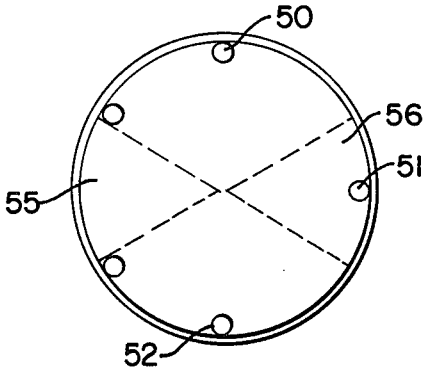
FIG. 8 is a bottom plan view of a cap according to this invention and useful in explaining operation.

These ribs would be positioned at for example three or more locations shown in FIG. 8 to provide the necessary support. Each of the vertical ribs may be a partial rib as for example rib 43 or 44 or may extend from a given location above the flange 41 to the top of the can as for example shown by rib 42 of FIG. 7. Essentially, the ribs will operate to coact with the top surface of the can when the necessary pushing operation is performed as for example shown in FIG. 2.

This structure which consists of the vertical ribs as shown in FIG. 7 also constitutes a peripheral flange which is not a continuous flange but essentially may consist solely of three ribs spaced for example as shown in FIG. 8. The three ribs designated in FIG. 8 as 50, 51 and 52 operate and are positioned to form an opening as 55. This opening again is diametrically opposed to the opening 56 which is formed in the bottom flange and which opening coacts with the peripheral recess 15 of a typical can.

Thus as one can asertain, the peripheral flanges as defined in this specification can be continuous or intermediate as long as the proper circumferential openings which may be between 30° to 90° are maintained. As one can ascertain from FIGS. 7 and 8, the top peripheral flange may be formed by vertically extending ribs located at the inner periphery of the cap which ribs essentially will perform the same operation as indicated. Thus, it should be apparent to one skilled in the art that the main feature of the present invention is to provide means which coact both with the recess of the can and which means have a circumferential opening when the means are emplaced within the peripheral recess 15 of the can.

The top peripheral flange may be segmented or continuous or may consist essentially of suitably positioned vertical ribs to enable one to thereby apply a suitable force to the cap which force will enable the cap to flex and cause the circumferential opening associated with the bottom flange as 19 to flex the cap in such a manner that the cap completely dislodges from the peripheral recess 15. It should be apparent to those skilled in the art that there are many alternative embodiments which will constitute suitable means to enable one to provide the features and structure of this invention.

It is further understood that the cap 20 cannot easily be dislodged or removed by an upward pulling action as such an upward pulling action will not free the flange 19 from the recess 15. Hence it is again repeated that in order to remove the cap, one must exert a pressure on the cap underneath the cutout portion associated with the flange 18. In this manner, the cap is distorted whereby the underlying flange 19 is substantially removed about its periphery from the recess 15 enabling an adult or one capable of exerting a suitable force to remove the cap from the can as per the instructions.

As indicated above, the cap is particularly adaptable to be employed with aluminum containers which have a recess 15 coextensive with a top dome shaped portion as 12. In any event, it is also apparent that any particular container could be accommodated as long as it has a recess as 15 and a suitable top surface which can abut with or coact with the circular flange 19.

It is therefore understood that based on the above description, various alternate embodiments will be apparent to those skilled in the art and all such alterations as well as additional uses are deemed to be included within the scope and spirit of the claims as appended hereto.

What is claimed is:

1. A child resistant closure cap apparatus for covering a container, said container of the type having a peripheral recess, with said recess positioned below an extending top portion associated with a substance removal end of said container, comprising:

a cup-shaped member having a closed top surface and an opened bottom, said cup shaped member having a first partial inner peripheral flange near said opened bottom and having a circumferential opening said first flange adapted to coact with said peripheral recess in said container, with a second partial inner peripheral flange located above said first flange and having a diametrically opposed opening with said second flange adapted to coact with said extending top portion when said first flange is coacting with said recess.

2. The child resistant cap according to claim 1, wherein said cup is circular in configuration having a circular top surface and circular bottom opening.

3. The child resistant cap according to claim 2, wherein said first and second peripheral flanges are semicircular flanges with said circumferential openings occupying between 30° and 90°.

4. The child resistant cap according to claim 1, wherein said first and second flanges are semicircular in cross section.

5. The child resistant cap according to claim 1, wherein said cup-shaped member is fabricated from a flexible plastic.

6. The child resistant cap according to claim 5, wherein said plastic is polyethylene.

7. The child resistant cap according to claim 1, wherein said first and second flanges are triangular in cross section.

8. The child resistant cap according to claim 1, wherein said container is fabricated from a metal.

9. The child resistant cap according to claim 8, wherein said metal is aluminum.

10. The child resistant cap according to claim 1, further including indicia located on said top surface of said cup-shaped member and capable of informing a user of the location of said first circumferential opening to enable removal of said cap by applying a force at an area designated by said indicia.

11. The child resistant cap according to claim 1, wherein said first peripheral flange comprises a plurality of spaced partial flange members each spaced a given distance from another to form said first partial inner peripheral flange having a circumferential opening.

12. The child resistant cap according to claim 1, wherein said second peripheral flange comprises a plurality of spaced partial flange members each spaced a given distance from another to form said second partial inner peripheral flange having a diametrically opposed opening.

13. The child resistant cap according to claim 1, wherein said second partial peripheral flange comprises a plurality of vertical ribs peripherally located on the inner surface of said cup-shaped member and having ends spaced from said first flange to enable said rib ends to coact with said top portion when said first flange is coacting with said recess.

14. The child resistant cap according to claim 13, wherein said vertical ribs extend towards said closed top of said cup member.

15. The child resistant cap according to claim 14, wherein said vertical ribs coact with said top surface of said cup member.

16. The child resistant cap according to claim 14, wherein said vertical ribs are positioned to form said second partial inner flange and located to provide support for said cup-shaped member with said circumferential opening defined by the absence of ribs in said circumferential area.

* * * * *